United States Patent [19]

Sos et al.

[11] Patent Number: 5,029,456

[45] Date of Patent: Jul. 9, 1991

[54] VIBRATION-DAMPED, HIGHLY ELASTIC KNITTING TOOL, PARTICULARLY HIGH-SPEED KNITTING MACHINE NEEDLE

[75] Inventors: Siegmund Sos, Albstadt; Albert Bausch, Burladingen; Michael Ringwald, Bitz, all of Fed. Rep. of Germany

[73] Assignee: Theodor Groz & Ernst Beckert Nadelfabrik KG, Albstadt, Fed. Rep. of Germany

[21] Appl. No.: 440,778

[22] Filed: Nov. 22, 1989

[30] Foreign Application Priority Data

Dec. 23, 1988 [DE] Fed. Rep. of Germany ..... 3843420

[51] Int. Cl.[5] ..... D04B 35/02

[52] U.S. Cl. ..... 66/123; 66/121

[58] Field of Search ..... 66/121, 123

[56] References Cited

U.S. PATENT DOCUMENTS 4,452,053 6/1984 Egbers et al. .
4,553,411 11/1985 Schuler et al. .
4,562,705 1/1986 Berentzen .
4,625,527 12/1986 Fukuhara ..... 66/123
4,783,976 11/1988 Sos .

FOREIGN PATENT DOCUMENTS 1635837 1/1970 Fed. Rep. of Germany .
2553547 6/1976 Fed. Rep. of Germany .
8708793 7/1987 Fed. Rep. of Germany .
0220351 10/1983 German Democratic Rep. ... 66/123
579433 2/1982 Japan ..... 66/123

OTHER PUBLICATIONS

EPO Search Report.

*Primary Examiner*—Werner H. Schroeder
*Assistant Examiner*—John J. Calvert
*Attorney, Agent, or Firm*—Frishauf, Holtz, Goodman & Woodward

[57] ABSTRACT

To provide for overall resiliency of a low-profile knitting needle in which the shank (7) has rib portions (16*a*, 16*b*) of which one is not more than 1.1 mm in height, the rib portions with spaced guide portions (12) defining therebetween an open window (15), which window is filled with a vibration and shock absorbing material (17) while ensuring retention of the shock absorbing material, one of the rib portions (16*a*, 16*b*) is formed with a through-slit (18), the vibration or shock damping material (17) being securely retained within the window without, however, a second rib portion reducing the resiliency of the needle and its ability to absorb shock and vibration transmitted along the length of the shank in operation of the needle in the knitting machine. The slit (18) can be placed at the end of the rib portion, adjacent a guide portion (12), centrally or at any other location along the length of the rib portion. If a plurality of rib portions and windows are provided, the interruptions of break points are, preferably, located alternately at an upper (10) and lower (11) side of the needle.

20 Claims, 2 Drawing Sheets

VIBRATION-DAMPED, HIGHLY ELASTIC KNITTING TOOL, PARTICULARLY HIGH-SPEED KNITTING MACHINE NEEDLE

Reference to related patents, the disclosures of which are hereby incorporated by reference:

U.S. Pat. No. 4,452,053, EGBERS et al.

U.S. Pat. No. 4,553,411, SCHULER et al.

U.S. Pat. No. 4,562,705, Berentzen

U.S. Pat. No. 4,783,976, Sos.

Reference to related publication:

German Utility Model Publication DE-GM 87 08 793.

FIELD OF THE INVENTION

The present invention relates to stamped yarn handling devices for use in knitting machines, and more particularly to high-speed knitting machine needles, which have a thin or narrow flexible rib portion between a butt and the needle head, for example a hook and latch.

BACKGROUND

Knitting machine tools to which the present invention relates, such as latch needles, bearded needles, compound needles, sinkers, and, in general, yarn handling devices for use in knitting machines, and especially high speed, for example circular knitting machines, have been proposed in which a shank has at least one butt and two guide portions which extend down to the lower regions of the shank. The shank defines an upper and lower edge, the upper and lower edge being formed in narrow ribs of only up to 1.1 mm height, coupled by the guide portions adjacent the ribs. The space between the ribs and guide portions form a window which, in order to reduce vibration of the needle in operation of the knitting machine, is filled with a vibration damping material, such as a plastic, aluminum or the like, securely connected to the shank.

The referenced U.S. Pat. Nos. 4,562,705 and 4,783,976 show ribs which are very thin, that is, have a maximum height of only 1.1 mm. These knitting needles, due to the thin ribs, are highly elastic. In operation, the butts of the needles are engaged with the cam race of the knitting machine to move the needles between projected and withdrawn positions. During such movements, the needles tend to vibrate. Vibration can be damped by filling a window between the ribs and guide portions with a vibration damping material. A suitable vibration damping material is a plastic such as polyamide, which is secured to the material of the shank along the edges. Placing such vibration damping material in the window permits increase of the operating speed and additionally improves the long-term strength and operating integrity of the knitting needle. Breakage of the ribs due to metal fatigue, or breakage of a needle hook due to transmitted vibration and subsequent metal fatigue, is effectively attenuated.

Other knitting machine needles or, in general, yarn handling devices were proposed in which a free space is placed adjacent the rib of a shank, that is, the guide portions of the shank are connected by only a single narrow rib, shown, for example, in FIGS. 4 to 8 of the referenced U.S. Pat. No. 4,562,705, or FIGS. 2 and 5 of the referenced U.S. Pat. No. 4,783,976. Such constructions have the advantage that the elasticity of the needle is very high, so that it is suitable for extremely high operating speed. The vibration filling material is, however, connected only at the guide portions and to the sole, highly flexible rib, so that the connection between the vibration filling material, typically plastic, and with the shaft, is highly stressed. Under severe operating conditions, and particularly during long operating periods, the connection between the vibration damping material and the adjacent holding portions of the needle may sever at various points. Consequently, the vibration damping fill may break out at various positions, or can become detached entirely. The vibration damping effect of the damping material thus is lost more or less. Metal fatigue may then result at the highly elastic needles, which may lead to operating malfunction.

FIGS. 1 to 3 of the referenced U.S. Pat. No. 4,562,705, and FIGS. 1, 3, 4, 6 and 7 of the referenced U.S. Pat. No. 4,783,976, illustrate highly elastic needles in which two ribs are provided, between which the vibration damping material is placed, entirely filling the window formed between the ribs and the adjacent guide portions of the shank. Since the window is entirely defined and surrounded by the ribs and by the guide portions, the vibration damping material can be secured along all sides, so that even after long operating time, partial or complete severing or break-out of the damping material from the needle will not generally occur. Yet, although this needle has the advantage of retaining the vibration damping material, the operating stresses placed on the needle when the butt is rapidly moved, cause the flexible ribs to be subjected to sudden impact which cannot be transferred to the ribs equally in form of transverse essentially attenuated bending oscillations. Such absorption of vibration, due to the impacts applied by the butt to obtain movement of the needle under control of the butt, can be accepted by the highly elastic knitting needles in which the space beneath or above the rib and the adjacent guide portions is open. When the window is completely surrounded, the second rib interferes with development of bending oscillations, even if only to a minor degree. It has been found that such needles with an entirely surrounded window space, and damping material located therein, can be operated only at somewhat lower operating speeds than those which have an open space adjacent the rib, although the danger of loss of damping material has been eliminated.

THE INVENTION

It is an object to develop a high-speed knitting tool or yarn handling device, and especially a knitting machine needle, which has the advantage of readily retained vibration damping material, without danger of loss or breakage thereof, while yet permitting high-speed machine operation, and providing long lifetime of the knitting tool or device.

Briefly, the knitting tool, typically a needle, is constructed essentially similar to the needles having an entirely surrounded window. In accordance with the present invention, however, one of the ribs which define the window is formed with a break or interruption or gap much smaller than the window, so that it will not interfere with absorption of vibration of the other, and continuous rib, yet remain available to hold the vibration damping material in position.

The knitting tool has the advantage of those knitting tools which have vibration damping material therein, and in which a single rib portion of the shank is in contact with vibration damping material, and available for attenuating shocks and vibrations transmitted from the butt of the needle towards the hook, so that the hook will not be subjected to vibratory or other stresses causing metal fatigue due to needle motion; yet, it has the advantage of the needles with an essentially closed window in positively and reliably retaining the vibration damping material in position.

The complete severing of one of the ribs associated with the adjacent guide portion ensures that impact stresses placed on the needle in operation, which occur, for example, upon engagement of the butt of the needle with the cam race of a knitting machine, are transferred by the single narrow rib. This single narrow rib has a limited height of at most 1.1 mm, and, then, is capable of converting the impact stresses into transverse bending movement; and, in combination with the damping material in the free space, so dampens the bending vibrations that hook breakage or breakage of portions of the knitting tool at the head end thereof are effectively prevented. The bond or connection between the vibration damping material in the window at the surrounding surfaces of the shank is ensured, however, so that excellent stability of the entire knitting tool is obtained, and especially of the thin rib portion thereof.

In accordance with a preferred embodiment of the invention, both of the ribs are thin, that is, have a rib height of at the most about 1.1 mm. It is, however, also possible to form only one of the ribs, namely the one which remains solid and unslit, with a height of up to only about 1.1 mm, and to form the other rib or slit, opposite the unslit or continuous rib, with different dimensions. The influence of the severed rib on the vibration behavior of the entire knitting tool is limited due to the presence of the cross slit. Thus, and in dependence on the use of the knitting tool, excellent results can be obtained even if the severed rib has dimensions different from the continuous or unsevered rib.

The length of the rib depends on the configuration of the knitting tool, and the use to which it is to be put, as well on the operating conditions of the machine within which it is to be used. Suitably, the length of the rib should be at least 5 mm, preferably 8 mm or more, so that the narrow rib of at the most approximately 1.1 mm height can effectively develop its elastic vibration-absorbing effect.

The cross slit or break or interruption slit can, preferably, be located on a rib adjacent the lower edge of the shank. "Upper edge" and "lower edge" of the shank are defined as those edges of the shank which are, in a knitting needle, at the open side of the hook and, in case of a latch needle, at the throw side of the latch, whereas the "lower edge" is that one which follows after the bent portion of the hook and, then, continues towards the butt end of the shank. The present invention, however, is equally applicable to knitting tools or yarn handling devices in which the cross slit is located on a rib positioned at the upper edge of the shank. This is particularly so for knitting tools which are of considerable length, or those which have more than one window; in such knitting tools, the arrangement preferably can be such that the shank is formed with at least two, longitudinally spaced, windows, defined by oppositely located guide portions and rib portions at the upper and lower edges. The cross slits are then, preferably, alternately placed in the ribs forming the upper and lower edges of the shank.

It has been found from actual experience that it is frequently of advantage to place the cross slit roughly in the center of the axial extent of the respective severed rib. It is, however, also possible, and for some needle types it has been found desirable, to form the severing slit close to or in the vicinity of the guide portion with which the rib or rib portion is associated, and, for example, immediately adjacent the guide portion beneath a butt.

The shape of the slit can be of any desired form; for example, it can be cut to be defined by two smooth, preferably parallel surfaces, extending, for example, essentially transversely to the longitudinal axis of the shank. The cross slit need not be formed, however, by parallel surfaces; it may be of essentially V-shape, with the wider portion of the V opening towards the outer edge of the respective rib.

The vibration damping material, for example, is a suitable plastic. Usually, it can be bonded or anchored with sufficient reliability in the adjacent surfaces of the rib and guide portions of the window, without any additional arrangements or provisions for maintaining it therein. In highly stressed knitting tools or yarn handling devices, however, and under extremely high speed operation, it is desirable to provide anchoring or holding elements adjacent a rib and/or a guide portion which defines the window within which the vibration damping material is placed. Such holding arrangements may, for example, be notches, or other shaped surface discontinuities or deformation, or projections which extend into matching grooves or notches of the vibration damping material, placed, for example, in the region of the outer edge of the vibration damping material (see, for example, German Utility Model DE-GM 87 08 793).

The vibration material is reliably retained along its edges, in accordance with a preferred feature of the invention, if the width of the severing slit is less than about 30% of the length of the rib which is severed. In accordance with an especially preferred feature of the invention, the cross slit is made so narrow that its width, at the narrowest point, is in the region of between approximately 0.05 to 0.1 mm. Usually, the cross slit is open, that is, is not itself filled with vibration damping material. It is possible, however, to fill the severing slit with vibration damping material if it is desired to obtain a smooth, continuous surface of the yarn handling tool also in the region of the respective cross slit. The fill for the material of the cross slit may be the same as the window vibration damping material, or other material, for example other vibration damping material or any other elastic material.

The yarn handling tool, in accordance with a feature of the present invention, is a stamped element, of stamped or punched high-quality sheet steel.

DRAWINGS

DETAILED DESCRIPTION

Figure 1:
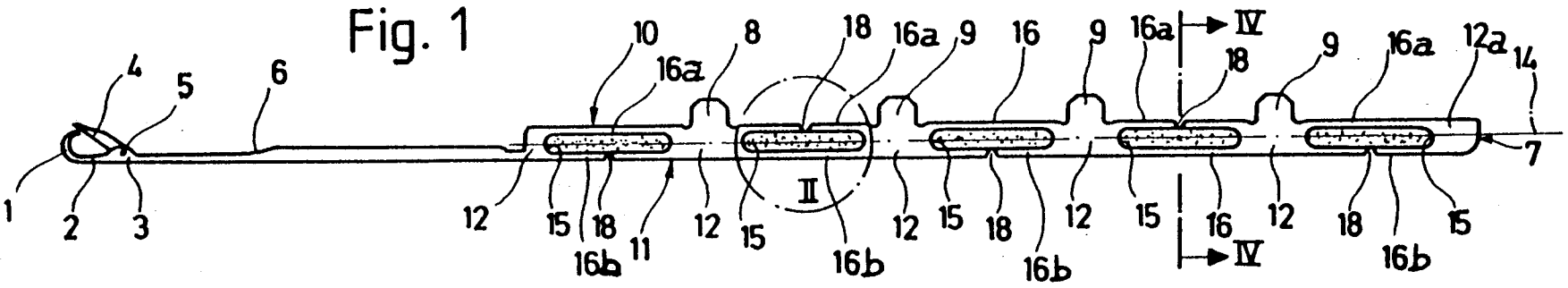
FIG. 1 is a schematic side view of a knitting needle using the present invention, illustrated in form of a circular knitting machine latch needle, having a plurality of control butts.
Figure 4:
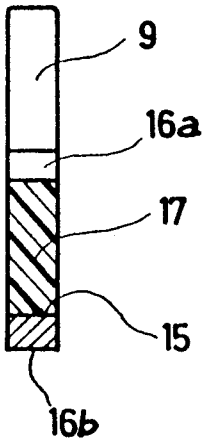
FIG. 4 is a longitudinal sectional view along line IV—IV of FIG. 1 to a different scale.

The general structure of the needle of FIG. 1 is known; it includes a hook or head 1, which merges with a neck 2. The neck 2, towards the rear end of the needle, then merges with a front or breast portion 3, which, as is customary, is formed with a longitudinal slit in which a latch 4 is pivotably retained. The latch pivot is shown schematically at 5 and may, for example, be formed as a depression or dimple punched into the breast portion 3.

The throat 6 of the needle is then extended towards the shank 7. The shank 7 has a first butt 8 and, additionally, three patterning butts 9. The present invention, of course, is also applicable to needles of an entirely different configuration.

Figure 5:
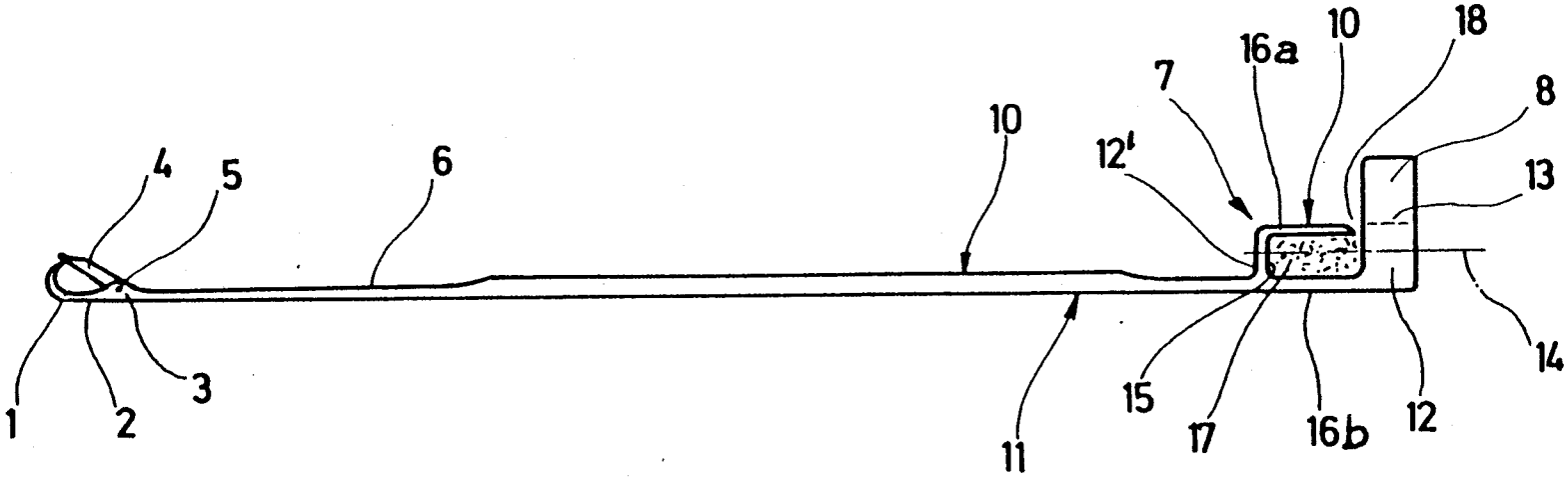
FIG. 5 is a highly schematic side view of another embodiment of the present invention in a latch knitting needle which has only a single butt.

Guide portions 12 are formed beneath the needle butt 8 as well as neath the patterning butts 9. The guide portions 12 extend from the upper edge 10 of the needle towards the lower edge 11 thereof. In FIG. 5, a broken line 13 indicates the dividing region between the butt 8 and the guide portion 12.

The guide portion may be of a width extending beneath the butt, or substantially narrower, as shown at the forward guide portion 12' in FIG. 5. Such a narrower guide portion may also be used in the embodiment of FIG. 1. A terminal guide portion **12*a* is located at the end of the needle opposite the hook or head 1 thereof, and terminates the shank 7**.

Figure 2:
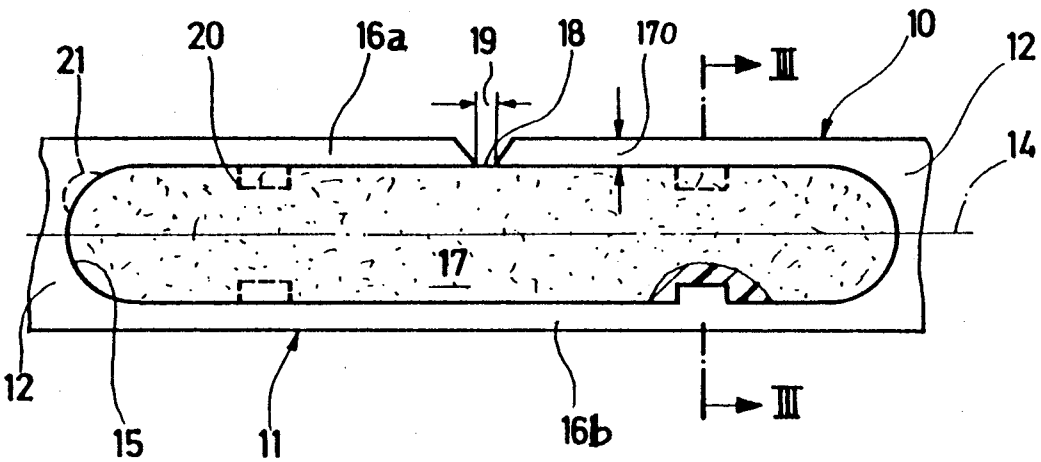
FIG. 2 is a highly enlarged side view of the region of a window, shown within the circle II of FIG. 1.

A free space or window 15 is located between two neighboring guide portions 12. The window 15 is elongated, and extends parallel to the axis of symmetry 14 of the needle. The window 15 is formed as an elongated cut-out or recess in the shank 7. The window 15 is defined not only between the guide portions 12 laterally thereof, but, further, by ribs **16*a* at the upper side and 16*b* at the lower side. The height dimension of the ribs is shown in FIG. 2 at 170**. This height dimension is, at the most, about 1.1 mm. The length of the window is at least 5 mm.

An elastic, vibration damping material 17 is located in at least one, and preferably all the windows 15 bounded by two guide portions 12 and two narrow ribs **16*a*, 16*b*. The vibration damping material 17** is securely connected with the surrounding material of the shank, which is, typically of steel. This vibration damping material may be a plastic, preferably polyamide; other elastic materials may be used, including metals such as aluminum.

In the embodiment of FIG. 1, a plurality of windows 15 are formed in the shank 7, spaced from each other in the direction of the longitudinal axis 14 by guide portions 12. Each one of the windows 15 is filled with vibration damping material 17 which is connected with the material of the shank 7 along the edges thereof.

In accordance with the present invention, one of the ribs **16*a*, or 16*b*, respectively, is severed by a cross cut or cross slit 18, into two longitudinally facing rib portions. This cross cut or cross slit 18 may have any desired form; it may be a slit with two parallel walls. As shown, however, the severing slit 18 is a cut which diverges outwardly, so that it has essentially V-shape, see FIG. 2**.

The minimum width of the slit 18, shown as dimension 19 in FIG. 2, is desirably less than 30% of the length of the respective rib **16*a*. Preferably, the width 19 is in the range of between approximately 0.05 to 0.1 mm. The cross slit 18 is not filled with vibration damping material 17**, that is, it is open towards the free edge.

Other embodiments of the invention are possible, for example the cross slit 18 may be filled with the same vibration damping material which is within the window 15 or with any other elastic material, preferably plastic, so that the edge 10 of the needle, as shown in FIG. 2, will be continuous and provide for a smooth outer continuous end surface.

As best seen in FIG. 1, adjacent windows 15 have the slits 18 at alternate sides of the needle. Thus, the windows 15, located along the length of the shank 7, have their respective ribs **16*a*, 16*b* alternately interrupted at the upper edge 10, or at the lower edge 11 of the shank, by cutting the respective rib 16*a*, 16*b* to form the slit 18 therein. The cross slit 18, preferably, is in the middle of the longitudinal extent of the respectively severed rib 16*a*, 16*b*, and is thus also located centrally of the material 17, and hence of the window 15. In FIG. 1, the lower rib 16*b*, adjacent the throat 6, is the first one which is severed, then followed by a slit 18 in the rib 16*a* of the next window 15, within the circle II. The slits are then alternately formed at the lower and upper side. Of course, the reverse pattern is possible, so that the rib 16*a* adjacent the throat 6 is severed, that is, at the upper side, and then, alternately, the subsequent rib or ribs are severed at opposite sides to that of the first rib 16*a***.

In the embodiment of FIG. 5, the rib **16*a* of the shank 7 is severed by the slit 18 immediately adjacent the butt 8 and the guide portion 12 beneath the butt 8, that is, the rib which is at the upper side 10 of the needle is severed. In an alternative embodiment, the rib 16*b*, at the lower edge 11 of the needle, could be severed adjacent the guide portion 12, or at a different location along the length of the axis 14** of the needle.

The placement of the severing slit 18, as shown in FIG. 5, could also be used in the needle of FIG. 1, in that the slit 18 is located immediately adjacent the associated butt 8, or 9, respectively, and the guide portion 12 therebeneath. Likewise, the cross slit 18 in the embodiment of FIG. 5 could be placed roughly in the center of the respective rib **16*a*, 16*b*. Another modification, within the scope of the invention, provides for placement of the cross slit 18 in the respective rib 16*a*, 16*b* at the upper or lower edge 10, 11 of the needle, respectively, close to or adjacent the guide portion 12 which is forward, that is, close to the hook 1**.

Figure 3:
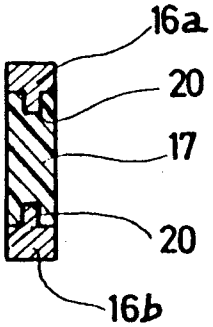
FIG. 3 is a longitudinal sectional view along line III—III of FIG. 2.

The vibration damping material 17 is securely anchored in the respective window at the ribs and guide portions adjacent the window 15, and fits within the window and the outline thereof. Usually, the flat cut surfaces which result upon stamping of the needle from a flat sheet of material are sufficient to provide for attachment surfaces so that the material 17 is secured in the window by a form fit. In some cases, and when the shaft 7 may be subjected to high loading, and especially to bending loading, so that the material 17 is also mechanically highly stressed, it may be desirable to provide additional attachment or anchoring elements on the ribs 16 and/or the guide portions 12. Such anchoring elements can be formed by projections 20 (FIGS. 2, 3) extending into the vibration damping material, for example within tiny notches thereof. Alternatively, the region of the ribs 16 and/or the guide portions 15 may be shaped to fit into suitably deformed portions of the material 17. FIG. 2 illustrates, at 21, a partial recess formed in the guide portion 12 adjacent the rib **16*a* in broken lines, which recess is filled with vibration damping material 17**. The present invention has been described in connection with needles in which both the rib 16*a* as well as 16*b*, and defining, together with the guide portions 12, the window 15, have a height 170 of not more than about 1.1 mm. It is, of course, also possible to form the rib which is severed with a different dimension, for example to form it somewhat higher than 1.1 mm, since, due to the cross slit 18, the influence of the severed rib on the vibration and shock absorbing behavior is low. The severed rib, essentially, has only the task to ensure that the vibration damping material is reliably retained within the window 15.

Various other changes and modifications may be made, and any features described herein in connection with any one of the embodiments may be used with any of the others, within the scope of the inventive concept.

We claim:

1. Punched or stamped knitting tool, particularly a knitting machine needle, having a flat shank (7) defining a longitudinal axis (14).

an upper edge (10) and a lower edge (11);

at least one but (8, 9) projecting from one of said edges;

at least two guide portions (12) extending from the upper edge of the shank to the lower edge thereof, one of said guide portions being located beneath the butt;

said shank being formed with a narrow flexible rib (16*a*) connecting said guide portions at the upper edge, and a narrow flexible rib (16*b*) connecting said portions at the lower edge, at least one of said ribs (16*a*, 16*b*) having a height (170) of only up to approximately 1.1 mm, said ribs (16*a*, 16*b*) and adjacent guide portions (12) defining a window (15); and a vibration damping material (17) located in said window (15) and securely connected in said window, wherein, in accordance with the invention, one of the ribs (16*a*, 16*b*) of any window is formed with a severing slit (18) extending essentially transversely to the longitudinal axis (14) of the shank; and wherein the width (19) of the severing slit (18) is less than 30% of the length of the respective severed rib.

2. The tool of claim 1, wherein both ribs (16*a*, 16*b*) delimiting said window (15) have a height (170) of only up to approximately 1.1 mm.

3. The tool of claim 1, wherein that one of the ribs (e.g. 16*b*) opposite the rib formed with said severing slit (18) has a height dimension (170) of at the most up to approximately 1.1 mm.

4. The tool of claim 1, wherein the length of the respective ribs (16*a*, 16*b*) is at least approximately 5 mm.

5. The tool of claim 1, wherein said severing slit (18) is formed in a rib (16*b*) located at the lower edge (11) of the shank.

6. The tool of claim 1, wherein the severing slit (18) if formed in a rib (16*a*) located at the upper edge (10) of the shank.

7. The tool of claim 1, wherein the shank (7) is formed with at least two longitudinally staggered windows (15);

and wherein said severing slits (18) are placed, alternately, in the respective ribs (16*b*, 16*a*) located at the lower edge (11) and upper edge (10) of the shank, respectively.

8. The tool of claim 1, wherein said severing slit (18) is located at least approximately in the middle of the axial extent of the respective rib (16*a*, 16*b*).

9. The tool of claim 8, wherein the width of the severing slit is between approximately 0.05 to 0.1 mm.

10. The tool of claim 1, wherein said severing slit (18) is formed in the respective rib (16*a*, 16*b*) adjacent to the guide portion (12) towards which said rib extends.

11. The tool of claim 10, wherein the guide portion (12) adjacent which the slit (18) is formed is positioned beneath a butt (8) of the tool.

12. The tool of claim 1, wherein said severing slit (18) has an outwardly divergent shape.

13. The tool of claim 1, wherein said severing slit (18), in cross section, has essentially V-shape.

14. The tool of claim 1, further including interlocking holding or anchoring means (20) formed on the shank, adjacent the window, and on the vibration damping material (17), respectively.

15. The tool of claim 1, wherein the width of the severing slit is between approximately 0.05 to 0.1 mm.

16. The tool of claim 1, wherein said severing slit (18) is open to the respective edge of the shank and is devoid of said vibration damping material (17).

17. The tool of claim 1, wherein said severing slit (18) includes a vibration damping or elastic material terminating at the respective edge of the shank to form a smooth edge contour for the shank.

18. The tool of claim 1, wherein said vibration damping material is connected to the ribs (16*a*, 16*b*) defining the window.

19. The tool of claim 1, wherein said vibration damping material is secured in the window by a form fit.

20. The tool of claim 19, wherein the width of the severing slit is between approximately 0.05 to 0.1 mm.

* * * * *

UNITED STATES PATENT AND TRADEMARK OFFICE

CERTIFICATE OF CORRECTION

PATENT NO. : 5,029,456

DATED : July 9, 1991

INVENTOR(S) : SOS et al

It is certified that error appears in the above-identified patent and that said Letters Patent is hereby corrected as shown below:

Title page, Section [73] Assignee:

Change the name of the Assignee to read -

--Theodor Groz & Söhne & Ernst Beckert Nadelfabrik KG--.

Signed and Sealed this

Ninth Day of March, 1993

*Attest:*

STEPHEN G. KUNIN

*Attesting Officer*

*Acting Commissioner of Patents and Trademarks*